US009441471B2

(12) United States Patent
Seth et al.

(10) Patent No.: US 9,441,471 B2
(45) Date of Patent: Sep. 13, 2016

(54) IN SITU HEAT GENERATION

(71) Applicant: Baker Hughes Incorporated, Houston, TX (US)

(72) Inventors: Kushal Seth, Houston, TX (US); Zhiyue Xu, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 229 days.

(21) Appl. No.: 13/768,939

(22) Filed: Feb. 15, 2013

(65) Prior Publication Data

US 2013/0220616 A1 Aug. 29, 2013

Related U.S. Application Data

(60) Provisional application No. 61/604,151, filed on Feb. 28, 2012.

(51) Int. Cl.
*E21B 43/24* (2006.01)

(52) U.S. Cl.
CPC ..... *E21B 43/24* (2013.01)

(58) Field of Classification Search
CPC ..... E21B 43/24
USPC ..... 166/300; 419/47, 48
See application file for complete search history.

(56) References Cited

U.S. PATENT DOCUMENTS

| | | | | |
|---|---|---|---|---|
| 2,261,292 | A | 11/1941 | Salnikov | |
| 2,436,198 | A | 2/1948 | Cardwell et al. | |
| 2,780,450 | A | 2/1957 | Ljungstrom | |
| 3,342,264 | A * | 9/1967 | Willard, Sr. | 166/300 |
| 4,085,799 | A * | 4/1978 | Bousaid et al. | 166/272.4 |
| 5,156,321 | A * | 10/1992 | Liburdi et al. | 228/119 |
| 5,484,488 | A | 1/1996 | Hart et al. | |
| 5,824,160 | A | 10/1998 | Khalil et al. | |
| 6,555,505 | B1 * | 4/2003 | King | C09K 8/74 166/307 |
| 6,984,614 | B1 | 1/2006 | Als | |
| 7,044,230 | B2 | 5/2006 | Starr et al. | |

(Continued)

FOREIGN PATENT DOCUMENTS

| | | |
|---|---|---|
| WO | 03040513 A3 | 5/2003 |
| WO | 2012112684 A2 | 8/2012 |

OTHER PUBLICATIONS

Heat of solution of Zinc Oxide in 2N Hydrochloric acid 46 J Res. Nat'l Bureau Stds. 2 ( Feb. 1951).*

*Primary Examiner* — Catherine Loikith
*Assistant Examiner* — Ryan Schneer
(74) *Attorney, Agent, or Firm* — Mossman, Kumar & Tyler, P.C.

(57) ABSTRACT

Introducing a fluid composition and a heat-generating fluid into a wellbore may improve timing and/or conditions of generating in situ heat downhole. The generated heat may be used to melt wax, and dissolve paraffins and asphaltenes or other deposits within the wellbore or in the reservoir itself. The fluid composition may include a base fluid and a metallic powder having a plurality of metallic powder particles. The base fluid may be or include a drilling fluid, a completion fluid, a stimulation fluid, a workover fluid, an activation fluid, and mixtures thereof. Each metallic powder particle may have a metallic particle core, and a coating disposed on the metallic particle core having a coating material. The metallic particle core may be released from the metallic powder particle. A heat-generating fluid may contact the released metallic particle core and thereby generate heat.

18 Claims, 1 Drawing Sheet

(56) References Cited

U.S. PATENT DOCUMENTS

| | | | | |
|---|---|---|---|---|
| 2006/0081374 | A1 | 4/2006 | Bland et al. | |
| 2009/0038797 | A1* | 2/2009 | Skala et al. | 166/280.1 |
| 2010/0314108 | A1* | 12/2010 | Crews | C09K 8/50 166/250.12 |
| 2011/0056691 | A1* | 3/2011 | King | B22F 3/1258 166/298 |
| 2011/0136707 | A1 | 6/2011 | Xu et al. | |
| 2011/0214881 | A1 | 9/2011 | Newton et al. | |
| 2012/0015852 | A1 | 1/2012 | Quintero et al. | |

* cited by examiner

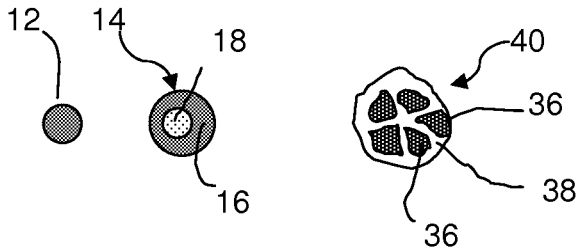
12
14
18
16
40
36
38
36

IN SITU HEAT GENERATION

CROSS-REFERENCE TO RELATED APPLICATION

This application claims the benefit of Provisional Patent Application No. 61/604,151 filed Feb. 28, 2012, which is incorporated by reference herein in its entirety.

TECHNICAL FIELD

The present invention relates to a method of generating heat in situ downhole by adding metallic powder particles to a base fluid, such as but not limited to a drilling fluid, a completion fluid, a stimulation fluid, a workover fluid, an activation fluid, and combinations thereof where the metallic powder particles have a coating and a metallic particle core releasable therefrom for generating heat in conjunction with a heat-generating fluid.

BACKGROUND

Crude oils and other heavier petroleum fraction often contain unwanted fouling deposits within them that may obstruct the flow of hydrocarbon production fluids. These deposits may also occur in the near-wellbore region of the formation, well production tubing, valves and chokes, flowlines, risers, surface treating vessels, and storage tanks. Tank bottoms are often a combination of paraffin, asphaltene, emulsion, and/or inorganic scale.

Conventionally, removal of wax, paraffins, asphaltenes, and the like has been achieved by mechanical, chemical or thermal methods. However, the mechanical and chemical methods can be costly and time consuming. Moreover, the chemical methods use additives that are harmful to the environment. Thermal treatment, may be performed with bottom hole heaters, hot oil, hot water or steam.

Various chemical methods for removing these types of deposits have been utilized in the past. Other solvents and dispersants such as a copolymer of a primary alcohol and ethylene oxide with sodium silicate and N-substituted succinimide ethers have been tried. A mixture of an alkyl or aralkyl polyoxyalkylene phosphate ester surfactant in free acid form or as a salt with a mutual solvent and water may be injected to remove paraffin deposits. This mixture must be at a temperature greater than the melting point of the wax to be effective. Since none of these processes melt the wax, they can only slowly eat away at its surface. This is not fast enough at most realistic surface-to-volume ratios. Furthermore, they create dispersions in water which must be disposed of or otherwise expensively dealt with.

The use of inorganic nitrate/nitrite compounds in redox reactions may result in an exotherm that melts the paraffin deposit and generates nitrogen gas. This technique does melt the wax, but requires the use of water to deliver the reactants, so that if the wax disperses at all, which it may well not, it does so into water which then must be expensively dealt with. Furthermore, gas generating redox reactions tend to be self accelerating, rendering them at best kinetically unpredictable, and at worst explosive.

An acid compound and a neutralizer compound may react exothermically to melt the paraffin wax deposits and form a dispersant to remove the melted fragments of the deposit from the surfaces of hydrocarbon (oil and/or gas) production equipment. Examples of acids used in this method include $H_3PO_4$, $H_2SO_4$, and HCl, whereas examples of neutralizers used include NaOH, KOH, MgO, $MgCO_3$ and $NaHCO_3$.

It would thus be desirable if other methods were devised to generate in situ heat downhole with heat-generating chemicals that are easier to handle and allow for a more efficient removal of fouling deposits from the near-wellbore region. It would also be desirable for the heat-generating chemicals to be predictable in terms of placement and functionality.

SUMMARY

There is provided, in one form, a method of generating in situ heat downhole. The method may include introducing a fluid composition into a wellbore. The fluid composition may include a reactive metallic powder comprising a plurality of metallic powder particles, and a base fluid. The base fluid may be or include a drilling fluid, a completion fluid, a stimulation fluid, a workover fluid, an activation fluid, and mixtures thereof. Each metallic powder particle may have at least one metallic particle core having a melting temperature (TP), and a coating disposed on the reactive metallic particle core where the coating may be or include a material having a melting temperature (TC). At least one reactive metallic particle core may be released from the plurality of metallic powder particles. A heat-generating fluid may contact the released metallic particle core and generate heat upon reaction of the heat-generating fluid with the released metallic particle core.

In another non-limiting embodiment, the releasing of the metallic particle core(s) may occur by a method, such as but not limited to dissolving the coating, disintegrating the coating, corroding the coating, and combinations thereof. Alternatively, the coating may have a coating material. The coating material may include a material, such as but not limited to Al, Zn, Mn, Mg, Mo, W, Cu, Fe, Si, Ca, Co, Ta, Re, Ni, an oxide thereof, a carbide thereof, a nitride thereof, alloys thereof, and a combination of any of the aforementioned materials. The amount of the metallic powder particles in the fluid composition may range from about 0.5 wt % independently to about 30 wt %.

In an alternative embodiment, at least two metallic powder particles are configured for solid-state sintering to one another at a predetermined sintering temperature (TS), and TS is less than TP and TC. A majority of the metallic particle cores are released from the plurality of powder particles to be contacted by a heat generating fluid for generating heat. The generated heat may be used to perform an action, such as but not limited to melting wax, dissolving paraffins, dissolving asphaltenes, increasing the near wellbore temperature prior to the pumping downhole of a hydraulic fracturing treatment, activating the expansion of polymers to be used as a sand screen, packer, and combinations thereof.

The coating of each metallic powder particle appears to help enhance the controllability of the releasing of the metallic particle core from the powder particles. The metallic particle core may be released from a metallic coating faster than a metallic particle core released from a non-metallic coating. By controlling the releasing of the metallic particle core, the desired timing and/or conditions of the generation of heat in situ downhole may also be controlled.

BRIEF DESCRIPTION OF THE DRAWING

FIG. 1 is a non-limiting, schematic illustration of three types of metallic powder particles with disintegrative portions thereof.

It will be appreciated that the various structures and parts thereof schematically shown in FIG. 1 are not necessarily to scale or proportion since many proportions and features have been exaggerated for clarity and illustration.

DETAILED DESCRIPTION

It has been discovered that the addition of metallic powder particles to a fluid composition that is introduced into a wellbore may demonstrate improved or enhanced controllability of generating heat and gas in situ downhole. The generated heat may be used to melt wax, and dissolve paraffins and asphaltenes or other deposits within the wellbore or in the reservoir itself. In another embodiment, the heat may be used to increase the near wellbore temperature before the hydraulic fracturing treatment is pumped downhole, which would decrease the chances of emulsion formation and/or formation damage. This would also help break the viscosity of a frac fluid, so that the frac fluid can flow back easily. In another embodiment, the heat may be used to activate the expansion of polymers that are used as sand screens, packers, and other downhole structures. In yet another embodiment, the generated gas may help to transport the waxes so that the waxes do not fall out of the solution.

One metallic powder particle may have at least one metallic particle core and a coating; in one non-limiting embodiment, the metallic powder particle may include at least two metallic particle cores. These metallic powder particles may include various electrochemically-active (e.g. having relatively higher standard oxidation potentials), lightweight, high-strength metallic particle core materials, such as electrochemically active metals. While it is desirable for the coating of each metallic powder particle to disintegrate, as a practical matter, it may not be possible to contact and disintegrate all coatings of all metallic powder particles. Thus, at least one metallic particle core may be used to generate heat. Alternatively, a majority of the metallic particle cores are released from the metallic powder particles, or from about 70 wt % of the metallic particle cores independently to about 100 wt % of the metallic particles cores, or from about 70 wt % independently to about 90 wt %. A 'majority' is defined herein to be at least 50 wt % of the metallic particle cores released from the plurality of metallic powder particles. However, success is not defined by the number or percentage of metallic particle cores released; success is obtained if more heat is generated in situ downhole by using the metallic powder particles within the fluid composition than in the absence of the fluid composition. The method of generating heat in situ downhole using these metallic powder particles is described in further detail below.

The metallic powder particles may be a shape, such as but not necessarily limited to spherical, elongated, rod-like or another geometric shape. The size of each metallic powder particle may range from about 50 nm to about 5000 μm, or alternatively from about 100 nm to about 750 μm. Each metallic powder particle may have a metallic particle core and a coating disposed thereon whereby the coating may be a metallic or non-metallic coating. In another non-limiting version, the metallic powder particle may be formed of two approximately equal, or even unequal, hemispheres, one of which is a relatively insoluble or non-disintegratable portion and the other of which is a relative dissolvable or disintegratable portion.

The metallic particle core may have a melting temperature ($T_P$). The coating may include a coating material having a melting temperature ($T_C$). In one non-limiting embodiment, the metallic powder particles may be configured for solid-state sintering to one another at a predetermined sintering temperature ($T_S$), and $T_S$ is less than $T_P$ and $T_C$. A plurality of these metallic powder particles may be sintered and/or further compacted together, or the metallic powder particles may remain in powder-form.

The metallic powder particles may be sintered together to form a metallic particle compact where at least one dimension of each metallic particle compact may range from about 500 μm independently to about 20 cm, alternatively from about 1 mm to independently to about 1 cm. In one non-limiting embodiment, the number of metallic powder particles sintered together may range from about 2 metallic powder particles independently to about 50 metallic powder particles, alternatively from about 2 metallic powder particles independently to about 20 metallic powder particles, from about 2 metallic powder particles independently to about 10 metallic powder particles.

There are at least three different temperatures involved: $T_P$ for the particle core, $T_C$ for the coating material, and a third one $T_{PC}$ for the binary phase of P and C. $T_{PC}$ is normally the lowest temperature among the three. In a non-limiting example, for a Mg core particle with an Al coating material, according to a Mg—Al phase diagram, $T_P$=650° C., $T_C$=660° C. and $T_{CP}$=437 to <650° C. depending on wt % ratio of the Mg—Al system. The metallic particle core may have or include a metal, such as but not limited to magnesium, aluminum, zinc, iron, manganese, alloys thereof, and combinations thereof. The size of the metallic particle core may range from about 25 nm to about 5000 μm, or from about 100 nm to about 750 μm in a non-limiting embodiment, or from about 25 nm independently to about 999 nm. A group of metallic powder particles can be sintered and compacted into a metallic particle compact. The size of the metallic particle compact may range from 500 μm independently to about 20 cm, or alternatively from about 1 mm to independently to about 1 cm.

The thickness of the coating may range from about 25 nm to about 2500 nm, or from about 100 nm to about 500 nm. The coating material may include a material, such as but not limited to Al, Zn, Mn, Mg, Mo, W, Cu, Fe, Si, Ca, Co, Ta, Re, Ni, an oxide thereof, a carbide thereof, a nitride thereof, alloys thereof, and a combination of any of the aforementioned materials. The coating material may have a chemical composition that is different from the chemical composition of the particle core.

The coating may be formed by any acceptable method known in the art and suitable methods include, but are not necessarily limited to, chemical vapor deposition (CVD) including fluidized bed chemical vapor deposition (FB-CVD), as well as physical vapor deposition, laser-induced deposition, electroplating and the like. The coating may be applied to the metallic particle cores to provide a means of accelerating or decelerating the disintegrating rate of each metallic powder particle.

The coating may have a single coating layer or a plurality of coating layers in a non-limiting embodiment. The plurality of coating layers may include a first coating layer disposed on the metallic particle core and at least a second coating layer disposed on the first coating layer. The first coating layer may be uniformly disposed on the generally central particle core of each powder particle. However, it will be appreciated that the powder particles may have other configurations, for example the coating material may not be uniformly applied over the particle core. The second coating layer may be uniformly disposed on the first coating layer. 'First coating layer' and 'second coating layer' as used herein are defined in relation to the generally central particle core, i.e. the 'first coating layer' is closest to the particle core, the 'second coating layer' may be disposed on the 'first coating layer', a 'third coating layer' may be disposed on the second coating layer and so forth.

One version of an alternate embodiment of a coating may have at least two coating layers that disintegrate at different rates. For example, a first coating layer may be disintegrative at one rate, and a second coating layer may be disintegrative at a second rate. In another non-limiting embodiment, the first coating layer may be more slowly disintegrative compared to the second coating layer, which may be relatively more rapidly disintegrative. It should be understood that the rates of disintegration between the first coating layer and the second coating layer may be reversed.

A coating may have multiple layers, such as a first coating layer, a second coating layer, a third coating layer, and so on. Each coating layer material may include a material, such as but not limited to Al, Zn, Mn, Mg, Mo, W, Cu, Fe, Si, Ca, Co, Ta, Re, Ni, an oxide thereof, a carbide thereof, a nitride thereof, alloys thereof, and a combination of any of the aforementioned materials. The first coating layer may have a chemical composition that is different from the second coating layer, which has a different chemical composition from a third coating layer, which has a different chemical composition from a fourth coating layer, and so on. In essence, each additional coating layer may have a chemical composition that is different than the coating layer upon which the additional coating layer is disposed, or layered between in the instance that there are more than at least three coating layers. In one non-limiting example, the coating may include up to 10 coating layers.

Disintegrative enhancement additives to the coating may include, but are not necessarily limited to, magnesium, aluminum, nickel, iron, cobalt, copper, tungsten, rare earth elements, and alloys thereof and combinations thereof. It will be observed that some elements are common to both lists, that is, those metals which can form a coating and/or a metallic particle core versus those which can enhance such metallic coating materials and/or metallic particle cores. The function of the metals, alloys or combinations depends upon what metal or alloy is selected as the major composition of the metallic particle core first.

A pre-determined condition may trigger the disintegration of the coating and subsequently release at least one metallic particle core from the plurality of metallic powder particles. The condition may include, but is not necessarily limited to a wellbore condition, including but not necessarily limited to wellbore fluid temperature, pressure or pH value, and/or the introduction of a second fluid. The releasing of the metallic particle core(s), and thereby the generation of heat downhole, may be postponed until the fluid composition is properly positioned to allow for better activity and better placement within the wellbore.

In one non-limiting embodiment, a second fluid may be introduced into the wellbore where the heat generation may be beneficial for lightening the heavy oil and/or decreasing viscosity of the hydrocarbon fluid. The second fluid may be different from the base fluid of the fluid composition, and the second fluid may trigger the disintegration of the coating(s). This second fluid may suitably be, but is not necessarily limited to, fresh water, brines, acids, hydrocarbons, emulsions, and combinations thereof so long as it is designed to dissolve all or at least a portion of the metallic powder cores from the plurality of the metallic powder particles. The acid may be a mineral acid (where examples include, but are not necessarily limited to HCl, $H_2SO_4$, $H_2PO_4$, HF, HClO, C2H4O3 (glycolic acid), and the like, and/or an organic acid (where examples include, but are not necessarily limited to acetic acid, formic acid, fumaric acid, succinic acid, glutaric acid, adipic acid, citric acid, lactic acid, and the like). The second fluid may contain corrosive material, such as select types and amounts of acids and salts, to control the rate of disintegration of the coating. 'Second fluid' as used herein is defined as being any fluid used in conjunction with the fluid composition capable of disintegrating the coating(s) of the metallic powder particles(s). The 'second fluid' is not necessarily introduced into the wellbore after the fluid composition.

The metallic particle core may be released from the metallic powder particle by a method, such as but not limited to dissolving the coating, disintegrating the coating, corroding the coating, melting the coating, and combinations thereof. The relative releasing rate of the coating depends on the value of the standard potential of the additive or coating material relative to that of the metallic particle core. For instance, to make a coating material that would release the metallic particle core at a relatively slower rate, the composition of the additive or coating material needs to have a lower standard potential than that of the metallic particle core. An Mg particle core with an Al disintegrative coating material is a suitable example. Or, to make this disintegrative coating material dissolve faster, standard potential of the disintegrative coating material needs to be lower than that of the particle core. An example of this latter situation would be a Zn particle core with a Mg disintegrative coating material.

A fluid composition may be introduced into a wellbore by pumping the fluid composition downhole. In order to practice the method, the fluid composition is first prepared by mixing the metallic powder particles into the desirable base fluid. In one non-limiting embodiment, the metallic powder particles may be uniformly dispersed within the base fluid. Any suitable mixing apparatus may be used for this procedure. In the case of batch mixing, the components of the fluid composition may be blended for a period of time sufficient to suspend or disperse the metallic powder particles within the base fluid.

The metallic powder particles may be dispersed in the base fluid in an amount ranging from about 0.01 lb per 1000 gal independently to about 1000 lb per 1000 gal, or from about 0.1 lb per 1000 gal independently to about 100 lb per 1000 gal in another non-limiting embodiment. The base fluid may be or include a drilling fluid, a completion fluid, a stimulation fluid, a workover fluid, an activation fluid, and mixtures thereof.

In an alternative embodiment, the fluid composition may have at least one surfactant, such as but not limited to non-ionic surfactants, anionic surfactants, cationic surfactants, amphoteric surfactants, and combinations thereof. Suitable nonionic surfactants include, but are not necessarily limited to, alkyl polyglycosides, sorbitan esters, methyl glucoside esters, amine ethoxylates, diamines ethoxylates, polyglycerol esters, alkyl ethoxylates, polypropoxylated and/or ethoxylated alcohols, sorbitan fatty acid esters including phospholipids, alkyl polyglycosides, gemini surfactants, sorbitan monooleate, sorbitan trioleate, glycerol fatty acid esters including mono- and/or dioleates, polyglycols, alkanolamines and alkanolamides such as ethoxylated amines, ethoxylated amides, ethoxylated alkanolamides, including non-ethoxylated ethanolamides and diethanolamides, and the like as well as block copolymers, terpolymers and the like.

Suitable cationic surfactants include, but are not necessarily limited to, arginine methyl esters, alkanolamines, and alkylenediamides. In one non-limiting embodiment the suitable anionic surfactants include alkali metal alkyl sulfates, alkyl ether sulfonates, alkyl sulfonate, branched ether sulfonates, alkyl disulfonate, alkyl disulfate, alkyl sulfosuccinate, alkyl ether sulfate, branched ether sulfates. Amphoteric or zwitterionic surfactants include, but are not necessarily limited to alkyl betaines and sulfobetaines.

A heat-generating fluid may contact the released metallic particle core(s) and thereby generate heat. 'Heat-generating fluid' is defined herein as a fluid that generates heat upon contact with the released metallic particle core(s). In one non-limiting embodiment, the heat-generating fluid may be or include, but is not limited to acids, bases, water, and mixtures thereof. In an alternative embodiment, the heat-generating fluid may be the same fluid as the second fluid described above. In a non-limiting embodiment, more heat is generated in situ downhole with the introduction of the metallic powder particles and subsequent contact with the heat-generating fluid and the fluid composition as compared to the wellbore absent the fluid composition and heat-generating fluid. After the generation of heat begins, the generated heat may be used for an action such as, but not limited to melting wax, dissolving paraffins, dissolving asphaltenes, polymer expansion, and combinations thereof. In another embodiment, the heat may be used to increase the near wellbore temperature before the hydraulic fracturing treatment is pumped downhole, which would decrease the chances of emulsion formation and/or formation damage. In another embodiment, the heat may be used to activate the expansion of polymers that are used as sand screens, packers, and other downhole structures. In yet another embodiment, the generated heat may help to transport the waxes so that the waxes do not fall out of the solution.

Shown in FIG. 1 is one version of a metallic powder particle 12 that is completely disintegrative, and an alternate embodiment of a metallic powder particle 14 that has a portion 16 that is disintegrative at one rate, and a portion 18 that is disintegrative at a second rate. In the particular, alternative embodiment of metallic powder particle 14 shown in FIG. 1, metallic powder particle 14 may have a generally central particle core 18 that is relatively more slowly disintegrative compared to portion 16, which is relatively more rapidly disintegrative and is a relatively uniform coating over the generally central particle core 18. It should be understood that the rates of disintegration between portion 16 and portion 18 may be reversed, or in a different embodiment, portion 18 is essentially not disintegrative in the process. However, it will be appreciated that metallic powder particle 14 may have other configurations, for example disintegrative portion 16 may not be uniformly applied over generally central particle core 18.

These coatings may be formed by any acceptable method known in the art and suitable methods include, but are not necessarily limited to, chemical vapor deposition (CVD) including fluidized bed chemical vapor deposition (FB-CVD), as well as physical vapor deposition, laser-induced deposition and the like, as well as sintering and/or compaction. In another non-limiting version, the particle may be formed of two approximately equal, or even unequal, hemispheres, one of which is a relatively insoluble portion 18 and the other of which is a relative dissolvable portion.

Also shown in FIG. 1 is a different embodiment of a metallic particle compact 40, which may have powder particle cores 36 and a thin metallic coating layer 38 thereon. Such metallic particle compacts 40 do not necessarily have a metallic coating layer 38 over the entire metallic particle compact 40. In a non-limiting instance, note that powder particle core 36 on the right side of metallic particle compact 40 is not covered by coating 38. Metallic particle compacts 40 may be reduced in size or disintegrated uniformly once disintegration occurs. In an alternative non-limiting embodiment of a metallic particle compact, at least two of the metallic powder particles 12, 14, 40, and combinations thereof, may be sintered together to form a metallic particle compact.

In a different non-limiting embodiment, the particles of FIG. 1 may be engineered to have increased strength, at least up until disintegration. In a non-limiting example, the portion 16 may be ceramic and the portion 18 may be metal.

It will be further understood that although metallic powder particles 12 and 14 are shown as spheres, they may be other shapes including, but not necessarily limited to, irregular rod-like, acicular, dentritic, flake, nodular, irregular, and/or porous. Including elongated versions of these, and the like with and without smoothed corners, and still be effective as described herein. In another non-limiting version, the metallic powder particle may be hollow or porous.

In another non-restrictive embodiment, the disintegrative portions of metallic powder particles 12 and 14 are made from a disintegrative metal sintered and/or compacted from a metallic composite powder comprising a plurality of metallic powder particles. These smaller powder particles are not to be confused with metallic powder particles 12 and 14.

In the foregoing specification, the invention has been described with reference to specific embodiments thereof, and has been described as effective in providing methods for generating in situ heat downhole. However, it will be evident that various modifications and changes can be made thereto without departing from the broader spirit or scope of the invention as set forth in the appended claims. Accordingly, the specification is to be regarded in an illustrative rather than a restrictive sense. For example, specific base fluids, predetermined conditions, heat-generating fluids, and metals and alloys thereof falling within the claimed parameters, but not specifically identified or tried in a particular method, are expected to be within the scope of this invention.

The present invention may suitably comprise, consist or consist essentially of the elements disclosed and may be practiced in the absence of an element not disclosed. For instance, the method may consist of or consist essentially for generating in situ heat downhole whereby a fluid composition having a metallic powder and a base fluid is introduced into a wellbore where the metallic powder may include a plurality of metallic powder particles having a metallic particle core and a coating disposed thereon, and at least one metallic particle core may be released from the plurality of metallic powder particles and subsequently contact a heat-generating fluid for generating heat.

The words "comprising" and "comprises" as used throughout the claims, are to be interpreted to mean "including but not limited to" and "includes but not limited to", respectively.

What is claimed is:

1. A method for generating in situ heat downhole comprising:

introducing a fluid composition into a wellbore, wherein the fluid composition comprises:

a metallic powder comprising a plurality of metallic powder particles, each metallic powder particle comprising:

at least one metallic particle core having a melting temperature (TP); wherein the metallic particle core comprises a metal selected from the group consisting of magnesium, aluminum, zinc, iron, manganese, alloys thereof, and combinations thereof;

a coating disposed on the metallic particle core, wherein the coating comprises a material having a melting temperature (TC);

wherein at least two metallic powder particles are configured for solid-state sintering to one another at a predetermined sintering temperature (TS), and TS is less than TP and TC and wherein the metallic powder particles are sintered together to form a metallic particle compact, wherein the size of the metallic particle compact ranges from about 500 μm to about 20 cm; and a base fluid selected from the group consisting of a drilling fluid, a completion fluid, a stimulation fluid, a workover fluid, activation fluid, and mixtures thereof;

releasing at least one metallic particle core from the plurality of metallic powder particles; and reacting the at least one released metallic particle core with a heat-generating fluid and thereby generating heat.

2. The method of claim 1, wherein the amount of the metallic powder particles in the fluid composition ranges from about 0.5 wt % to about 30 wt %.

3. The method of claim 1, wherein at least one dimension of each metallic powder particle ranges from about 50 nm to about 5000 μm.

4. The method of claim 1, wherein the releasing the at least one metallic particle core may occur by a method selected from the group consisting of dissolving the at least one coating, disintegrating the at least one coating, corroding the at least one coating, melting the at least one coating, and combinations thereof.

5. The method of claim 1, wherein the coating comprises a material selected from the group consisting of Al, Zn, Mn, Mg, Mo, W, Cu, Fe, Si, Ca, Co, Ta, Re, Ni, an oxide thereof, a carbide thereof, a nitride thereof, alloys thereof, and a combination of any of the aforementioned materials; and wherein the coating material has a chemical composition that is different from the chemical composition of the metallic particle core.

6. The method of claim 1, wherein the coating comprises a single coating layer.

7. The method of claim 1, wherein the coating comprises a plurality of coating layers.

8. The method of claim 7, wherein the plurality of coating layers comprises a first coating layer disposed on the metallic particle core and at least a second coating layer disposed on the first coating layer.

9. The method of claim 8, wherein the first coating layer comprises a material selected from the group consisting of Al, Zn, Mn, Mg, Mo, W, Cu, Fe, Si, Ca, Co, Ta, Re, Ni, an oxide thereof, a carbide thereof, a nitride thereof, an alloy thereof, and a combination of any of the aforementioned materials; wherein the at least second coating layer comprises a material selected from the group consisting of Al, Zn, Mn, Mg, Mo, W, Cu, Fe, Si, Ca, Co, Ta, Re, Ni, an oxide thereof, a carbide thereof, a nitride thereof, an alloy thereof, and a combination of any of the aforementioned materials; and wherein the first coating layer comprises a chemical composition that is different from the at least second coating layer.

10. The method of claim 1, wherein the coating has a thickness ranging from about 25 nm to about 2500 nm.

11. The method of claim 1, wherein at least one dimension of the metallic particle core ranges from about 25 nm to about 5000 μm.

12. The method of claim 1, wherein the heat-generating fluid is selected from the group consisting of acids, bases, water, and mixtures thereof.

13. The method of claim 1, further comprising performing an action with the generated heat, wherein the action is selected from the group consisting of:

melting wax;

dissolving paraffins;

dissolving asphaltenes;

increasing the near wellbore temperature prior to the pumping downhole of a hydraulic fracturing treatment;

activating the expansion of polymers to be used as a sand screen, packer, and combinations thereof;

and combinations thereof.

14. The method of claim 1, further comprising generating more heat in situ downhole as compared to the wellbore absent the with the introduction of the fluid composition.

15. The method of claim 1, wherein a majority of particle cores are released from the plurality of powder particles.

16. The method of claim 1 where the coating prevents the at least one metallic particle core from contacting the heat-generating fluid prior to the releasing of the at least one metallic particle core.

17. A method of generating in situ heat downhole comprising:

introducing a fluid composition into a wellbore, wherein the fluid composition comprises:

a metallic powder comprising a plurality of metallic powder particles, wherein the amount of the metallic powder particles in the fluid composition ranges from about 0.5 wt % to about 30 wt %, each metallic powder particle comprising:

at least one metallic particle core having a melting temperature (TP); wherein the metallic particle core comprises a metal selected from the group consisting of magnesium, aluminum, zinc, iron, manganese, alloys thereof, and combinations thereof;

a coating disposed on the metallic particle core; wherein the coating comprises a material selected from the group consisting of Al, Zn, Mn, Mg, Mo, W, Cu, Fe, Si, Ca, Co, Ta, Re, Ni, an oxide thereof, a carbide thereof, a nitride thereof, alloys thereof, and a combination of any of the aforementioned materials; and wherein the coating material has a melting temperature (TC); and a base fluid selected from the group consisting of a drilling fluid, a completion fluid, a stimulation fluid, a workover fluid, an activation fluid, and mixtures thereof;

releasing at least one metallic particle core from the plurality of metallic powder particles; wherein the releasing the at least one metallic particle core may occur by a method selected from the group consisting of dissolving the at least one coating, disintegrating the at least one coating, corroding the at least one coating, and combinations thereof; and generating heat by reacting the at least one released metallic particle core with a heat-generating fluid.

18. A method for generating in situ heat downhole comprising:

introducing a fluid composition into a wellbore, wherein the fluid composition comprises:

a metallic powder comprising a plurality of metallic powder particles, each metallic powder particle comprising:

at least one metallic particle core having a melting temperature (TP);

a coating disposed on the metallic particle core, wherein the coating comprises a material having a melting temperature (TC); and wherein at least two metallic powder particles are configured for solid-state sintering to one another at a predetermined sintering temperature (TS), and TS is less than TP and TC;

where the coating prevents the at least one metallic particle core from contacting a heat-generating fluid prior to the releasing of the at least one metallic particle core;

a base fluid selected from the group consisting of a drilling fluid, a completion fluid, a stimulation fluid, a workover fluid, activation fluid, and mixtures thereof;

releasing at least one metallic particle core from the plurality of metallic powder particles, wherein a majority of particle cores are released from the plurality of powder particles; wherein the metallic particle core comprises a metal selected from the group consisting of magnesium, aluminum, zinc, iron, manganese, alloys thereof, and combinations thereof;

reacting the majority of released metallic particle cores with the heat-generating fluid and thereby generating heat; and performing an action with the heat selected from the group consisting of:

melting wax;

dissolving paraffins;

dissolving asphaltenes;

increasing the near wellbore temperature prior to the pumping downhole of a hydraulic fracturing treatment;

activating the expansion of polymers to be used as a sand screen, packer, and combinations thereof; and combinations thereof.

* * * * *